US006467388B1

(12) United States Patent
Malakatas

(10) Patent No.: US 6,467,388 B1
(45) Date of Patent: Oct. 22, 2002

(54) METHOD FOR ENGAGING AT LEAST ONE AERIAL TARGET BY MEANS OF A FIRING GROUP, FIRING GROUP OF AT LEAST TWO FIRING UNITS, AND UTILIZATION OF THE FIRING GROUP

(75) Inventor: Nicolas Malakatas, Zurich (CH)

(73) Assignee: Oerlikon Contraves AG, Zurich (CH)

( * ) Notice: Subject to any disclaimer, the term of this patent is extended or adjusted under 35 U.S.C. 154(b) by 0 days.

(21) Appl. No.: 09/363,965

(22) Filed: Jul. 29, 1999

(30) Foreign Application Priority Data

Jul. 31, 1998 (CH) ..... 1611/98

(51) Int. Cl.[7] ..... F41G 3/08

(52) U.S. Cl. ..... 89/41.03; 89/41.07; 89/1.11; 342/67; 702/144; 235/411

(58) Field of Search ..... 89/41.03, 41.07, 89/1.11; 342/67; 702/144; 235/411

(56) References Cited

U.S. PATENT DOCUMENTS

| | | | | |
|---|---|---|---|---|
| 4,205,589 A | * | 6/1980 | Engler et al. | 89/41.07 |
| 4,647,759 A | | 3/1987 | Worsham et al. | 235/411 |
| 4,741,245 A | * | 5/1988 | Malone | 89/41.03 |
| 5,072,389 A | | 12/1991 | Wernli | 364/423 |
| 5,206,452 A | | 4/1993 | Stamper et al. | 89/1.11 |
| 5,208,418 A | * | 5/1993 | Toth et al. | 89/41.07 |
| 5,471,213 A | * | 11/1995 | Hergesheimer | 89/41.07 |
| 5,511,218 A | | 4/1996 | Castelaz | 395/800 |
| 5,682,006 A | * | 10/1997 | Perry et al. | 89/41.03 |

FOREIGN PATENT DOCUMENTS

| | | |
|---|---|---|
| DE | 38 18444 A1 | 12/1989 |
| EP | 0 383 043 A1 | 8/1990 |
| EP | 0 852 326 A1 | 7/1998 |
| WO | WO 98/09131 | 3/1998 |

* cited by examiner

*Primary Examiner*—J. Woodrow Eldred
(74) *Attorney, Agent, or Firm*—Townsend and Townsend and Crew LLP; Guy W. Chambers

(57) ABSTRACT

A method for engaging one or several aerial targets by means of a firing group (10) of autonomous, but cooperating, firing units (12, 112), wherein each firing group has a fire control unit (14, 114) and at least one weapon (16, 116). Several firing units (12, 112) are linked by a signal transmission system (70), which connects their fire control units (14, 114). Each fire control unit (14, 114) autonomously monitors its airspace area for enemy aerial targets. Subsequently, each fire control unit (14, 114) determines a threat assessment, for which the monitoring results of all fire control units (14, 114) are used. The selection of an aerial target to be engaged by a firing unit (12, 122) is subsequently made by the associated fire control unit (14, 114) on the basis of,the threat assessment and on the basis of the status of the weapons (16, 116) of the entire firing group (10). Firing groups (10) of this type are preferably used for engaging rapidly moving aerial targets in order to defend friendly object to be protected against the action of the aerial targets.

9 Claims, 6 Drawing Sheets

METHOD FOR ENGAGING AT LEAST ONE AERIAL TARGET BY MEANS OF A FIRING GROUP, FIRING GROUP OF AT LEAST TWO FIRING UNITS, AND UTILIZATION OF THE FIRING GROUP

FIELD OF THE INVENTION

The invention relates to a method for engaging at least one aerial target by means of at least two firing units linked to form a firing group, therein monitoring of the airspace for searching for the at least one aerial target is performed by the individual firing units, thereafter an assessment of the threat is performed on the basis of the search, and an aerial target is assigned to each one of the at least two firing units for engaging it, The invention further relates to a firing group of at least two firing units, as well as to the utilization of the firing group for defending a target to be protected.

BACKGROUND OF THE INVENTION

Within the scope of the present specification, firing units are understood to be units for engaging mobile targets, in particular but not exclusively, rapidly moving aerial targets, which can arrive at any arbitrary altitude. Such firing units customarily consist of a fire control unit and at least two weapons, which can be single-or multi-barrel guns and/or launching devices for guided missiles. The term firing group should be understood to consist of two or more firing units, which are employed within the same time period for monitoring the same or adjacent areas of the airspace and for engaging enemy aerial targets therein.

Fire control units customarily used as components of such firing units, have one or several antenna systems, which are suitable for different monitored areas and can be alternately employed for the search, acquisition and tracking of aerial targets to be engaged. One firing unit customarily has always only a single active antenna in use. Therefore only a defined angular space can be monitored, i.e. for example an area close to the ground at a low altitude, or an area at high altitude, and furthermore, the angular space monitored in this way is relatively small. This can have the result that aerial targets, for the engagement of which the weapons of the firing unit would have sufficient capacity, cannot be detected by the associated fire control unit. The engagement of such aerial targets then fails, not for a lack of usable weapons, but for the lack of sufficient monitoring of the airspace. Searching and acquisition of an aerial target by means of the fire control unit of a neighboring firing unit does not bring any improvement, since this fire control unit is not usable for controlling the weapons of the first firing unit because systems for transmitting the appropriate signals are lacking.

Although a better utilization of the capacity of the weapons of the firing unit could be achieved if, with the same number of weapons, the fire control unit either were to be designed in such a way that its antennas intended for monitoring different angular spaces could be used simultaneously, or that the firing unit would be equipped with several fire control unit. But both options are comparatively expensive, since the fire control units are mostly more cost-intensive device than the weapons.

An improvement of monitoring the airspace and engaging aerial targets is achieved with the linkage of several firing units to form a firing group. Such a linkage can be achieved in ways of different intensity, or respectively in different degrees. With the known firing groups consisting of linked firing units, the linkage is provided such, that one selected firing unit, or respectively the fire control unit of this firing unit, is leading, i.e. performs a so-called "master" function and takes on the preponderant portion of the calculations, while the remaining firing unit, or respectively their fire control units, are assigned a so-called "slave" function. The firing unit with the "master" function has a tendency to require more extensive electronics than the firing units with the "slave" functions. This means that either all fire control units must be sufficiently equipped for performing "master" functions when required, or that it is necessary to create differently equipped firing units, basically one "master" unit and several "slave" units per firing group. Such over-equipping is avoided in the first case, but tactical flexibility is lost to a large extent, since inter alia the position of the "master" unit and the "slave" units are fixed for at least a defined time period. Although tactical flexibility is achieved in the first case, the expense of apparatus is comparatively large since, with firing units which are all equipped the same, the firing units performing a "slave" function are obviously over-equipped, so to speak. A further important disadvantage of firing groups composed of several firing units, one of which exercises the "master" function, lies in its vulnerability. If the firing unit with the "master" function fails, either because of an internal defect or as a result of the effects of enemy weapons, the linkage breaks down. This breakdown of the linkage cannot be repaired in firing groups with differently equipped firing units, since there is no redundancy of the failed firing unit, or respectively its fire control unit. With firing units which are overall equipped in the same way, another firing unit, a redundancy so to speak, could take over the "master" function, but it would be necessary to take appropriate and expensive measures to cause this transfer of the "master" function.

OBJECT AND SUMMARY OF THE INVENTION

It is therefore the object of the invention to find a solution for the problem of linking the firing units of a firing group in such a way that improved airspace monitoring and utilization of the capacities of the weapons is achieved, wherein simultaneously the outlay for the systems, which are additionally needed by the individual firing unit, and the vulnerability of the firing group should be minimized.

This object is attained

An essential advantage of the firing group in accordance with the invention lies in that its vulnerability is less in comparison with the vulnerability of conventional, linked firing units with a "master" unit and at least one "slave" unit, because in spite of their coordinated activities, the firing units are equal and autonomous. If one of the firing units fails, the size of the firing group is reduced, but is functioning basically remains the same. Since no firing unit is a "master" unit, there can be no failure of a "master" unit. But in their deployment, the same advantages are obtained as with the previously known firing group with "master" and "slave"units, since the firing units linked in accordance with the invention are coordinated in respect to their functions. This is achieved in particular in that, for the assessment of the threat to a common object to be protected, the search results of all search antennas of all fire control units are considered, and for the selection of a aerial target to be engaged by a firing unit this assessment of the threat as well as the respective state of the weapons are considered.

The linkage in accordance with the invention of the firing units into a firing group, in which the firing units are equal and autonomous, but act in coordination when deployed, permits a more efficient engagement of aerial targets than would be the case when deploying a firing group with the same number and types of firing units, but without a linkage of the firing units, and without an increase of the vulnerability, such as must be accepted in connection with conventional firing groups with a "master" unit and several "slave" units. On the one hand, this is because of an increase and complementation of the monitored airspace by the fire control unit, and on the other hand because of full utilization of the capacity and optimization of the deployment of the weapons. The total of the search area of the fire control units of the firing group in accordance with the invention is not greater than the total of the search areas of the individual fire control units, and the total of the weapons of the firing group does not exceed the sum of the weapons of the individual firing units. In spite of this, the total efficiency of the firing group is much higher than the total efficiency of the individual firing units. There are several reasons for this: by means of a suitable arrangement of the different fire control units and the suitable selection of the search antennas employed by the individual fire control unit, it is possible in this way to avoid zones which are dead to search, but can be reached by the weapons. Furthermore, the deployment of the weapons of a firing unit is not limited to engaging the aerial target detected by its individual fire control unit, it is possible instead to engage aerial targets which are detected by other fire control units, as long as they are within the range of the weapons, because of which it is prevented that a weapon is idle, or respectively is not deployed toward a reachable aerial target simply because cause it has not been detected. Moreover, it is prevented that one aerial target is detected by two fire control units and is engaged by the weapons of both firing units, while another aerial target, which would be detectable by at least one of the two fire control units, is not engaged at all.

Thus, while a firing group of firing units which are not linked to each other only constitutes a firing unit aggregation of a correspondingly reduced fighting value, and a conventionally linked firing group with "master" and "slave" units is comparatively vulnerable or very expensive, the firing group in accordance with the invention with autonomous, coordinated firing units constitutes a firing unit combination of comparatively little vulnerability and increased fighting value. In addition to the firing units themselves, it is only necessary to provide a signal transmission system for the transmission of signals between the fire control units, wherein the signal transmission can take place in any arbitrary manner, for example by means of fixed or mobile lines as well as via wireless communications systems. The firing units linked in this way are basically autonomous in regard to monitoring the airspace, but in spite of this they act in a coordinated manner. In assessing the threat, each fire control unit also takes into consideration the search results of the antenna systems of the remaining fire control units, and the selection of the aerial targets to be engaged takes place in respect to the total threat on the one hand, and on the other hand to the deployability of all weapons.

Linked firing groups can be formed by mobile, i.e. field antiaircraft weapons, as well as fixedly installed, i.e. fortification antiaircraft weapons, as well as by a combination of field antiaircraft and fortification antiaircraft weapons, if required.

Already existing firing units can be designed in the sense of retrofitting in such a way that they can be linked with the same or other firing units.

Control of the individual weapons takes place electronically, as is customary, wherein the appropriate electronic unit is essentially arranged in the respectively associated fire control unit, although generally the individual weapons also have an electronic weapons device. Control of the firing units linked into the firing group also takes place automatically, with the exception of certain functions such as, for example, the selection, or respectively the deployment of antennas, which takes place manually, if required. Since, as just mentioned, every fire control unit has its individual electronic unit anyway, it is advantageous to build the electronic system of the firing group on the basis of these electronic units. The hardware of the electronic units should basically be sufficient for the firing group, so that it merely needs to be complemented by required software. However, it is also possible to expand not only the signal transmission system as an additional system, but also to provide a central electronic element, which should partially or exclusively constitute the electronic system of the firing group.

As explained above, the purpose of the linkage of the firing units into firing groups is to respectively deploy the fire control units and weapons in each threat situation in such a way that the altogether best possible engagement of the aerial targets results. This requires the making of appropriate decisions regarding the adaptation of the deployment of the weapons. The appropriate decisions can only be sensibly made if there is a consistency regarding the basis for the decisions. With conventional linked firing groups with a "master" unit, obtaining the required consistency is comparatively problem-free. With the firing group in accordance with the invention, which does not have a "master" unit, but only autonomous, basically equal firing units, without an elaborate permanent data exchange the required consistency can only be reached if the decision-making takes place simultaneously, i.e. if it is only initiated after the respective bases for the decision have been made available by a data transfer between the fire control units. The data transfer is based on the partial decision bases available to the respectively other fire control units. This means that each-fire control unit uses the information available to it for decision-making only when this information is also available to the remaining fire control units.

The antenna systems, or respectively sensor systems of the individual fire control units have a decisive importance for the efficient utilization of the firing group in accordance with the invention. Generally, each fire control unit has an antenna system with several antennas, in particular a search antenna unit, or respectively search sensor unit, and a tracking antenna unit, or respectively a tracking sensor, are provided in most cases. The search antenna system is used for detecting aerial targets and can be designed in such a way that it permanently rotates or changes its azimuth. The tracking antenna unit is used for the acquisition and tracking of already detected aerial targets, it follows the aerial target in azimuth and elevation and is used for ranging the position of the aerial target.

Each search antenna unit has at least one search antenna. Various antenna types are known, which in particular differ in that the areas of the airspace which can be covered by them are different. For example, there are antennas for areas near the ground, or respectively lower altitudes, and antennas for higher altitudes. With fixedly installed fire control units it can be sufficient, depending on the topographic situation, to provide a search antenna unit with only a single search antenna, which is specifically matched to the requirements. For achieving tactical flexibility in connection with the use by mobile, or respectively field antiaircraft firing units in particular, it is preferable to equip the fire control units with search antenna units which have several search antennas which can be differently deployed, wherein alternatively one of the search antennas can be deployed.

The deployment of the respectively suitable search antenna from the group of search antennas available in the search antenna unit takes place in accordance with tactical considerations, for example by the person assigned to the fire control, or automatically in cooperation with an early warning system. To ease the making of the selection of the suitable search antenna unit, certain facts, for example the topography of the surroundings of the firing group and the weapons available to the enemy, or respectively their incoming altitude, can already be stored in the form of basic or marginal conditions.

As already mentioned, firing units linked into firing groups in accordance with the invention are deployed for engaging aerial targets, although basically such linked firing groups could also be used for engaging ground targets. The aerial targets to be engaged can be, for example, aircraft, drones or missiles.

An essential purpose of the firing groups in accordance with the invention is to defend important friendly objects against aerial attacks by the enemy. Classification of the objects to be protected in accordance with their value, or respectively their need for defense, is based on strategic, tactical and/or political viewpoints. Generally the firing groups themselves are considered to be important objects.

It can basically be assumed that all weapons of a firing group, even those of linked firing groups, engage the same aerial target, since generally the fire control units cannot perform the ranging of several targets simultaneously or quasi-simultaneously. If the number of aerial targets to be engaged equals the number of firing units, each firing unit will generally engage one aerial target. If the number of the aerial targets to be engaged is less than the number of the firing units, at least a portion of the aerial targets will be engaged by more than one firing unit. If the number of the aerial targets to be engaged is greater than the number of firing units, each firing unit will engage one target, while one or more of the aerial targets remain unengaged, namely those, which have been classified as the least threatening, until one of the aerial targets which can be engaged is neutralized or can no longer be engaged.

The basis for the classification of the aerial targets in accordance with the threat they pose to the object to be protected is constituted on the one hand by a theoretical threat definition, which is stored in the electronic device, and on the other hand by the data determined by the fire control units regarding the aerial targets in the monitored airspace and their movements. However, in particular in connection with stationary firing groups, it is possible to include in the threat definition the vulnerability of the friendly objects to be protected to the threats by the aerial targets, for example aerial targets which threaten a firing group or a nuclear power plant can basically be classified as particularly threatening.

Further details and advantages of the invention will be described in greater detail in what follows by means of exemplary embodiments of firing groups, making reference to the drawings.

DETAILED DESCRIPTION OF THE PREFERRED EMBODIMENTS

Figure 1A:
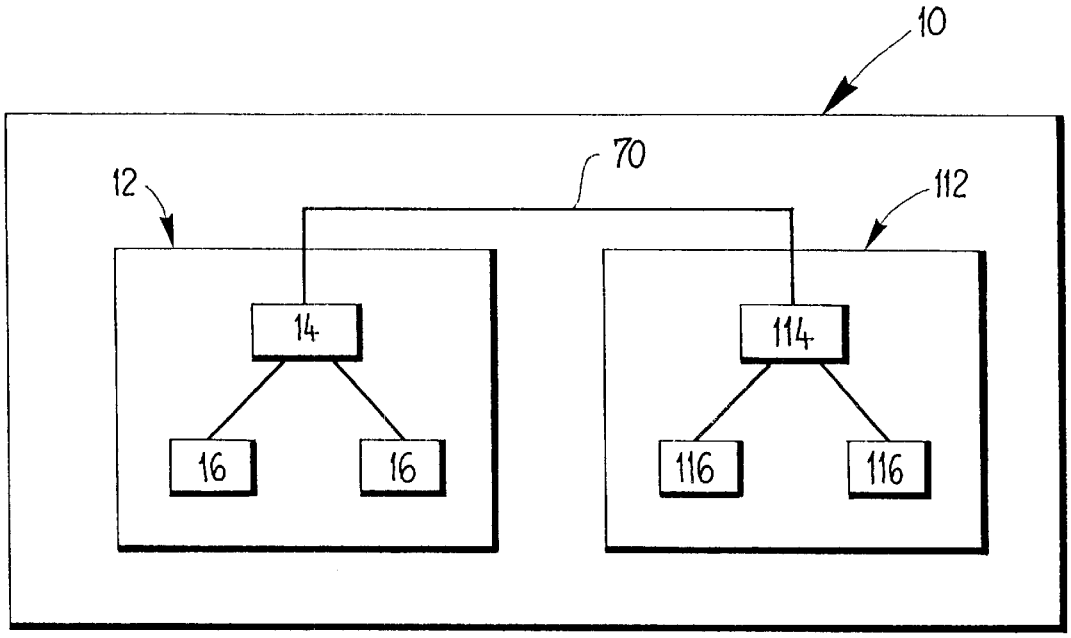
FIG. 1A is a schematic representation of a firing group with two linked firing units.

FIG. 1 schematically shows a combination in accordance with the invention of two firing units into a firing group 10, which comprises the two linked firing units 12, 112, each of which has a fire control unit 14, or respectively 114, and two weapons 16, or respectively 116. In the present case, the two firing units 12, 112 of the firing group 10 are constituted by identical weapons 16, 116 and identical fire control units 14, 114, however, different firing units can also be linked. Linkage of the firing units 12, 112 takes place via the two fire control units 14, 114 by means of a signal transmission system 70, which need to be an actual signal line. For example, the weapons 16 of the firing unit 12 are directly connected via their individual fire control unit 14, and only indirectly with the fire control unit 114 of the other firing unit 112 via the individual fire control device 14. The linkage of the firing units 12, 112 into a firing group 10 by means of the signal system 70 takes place in accordance with customary techniques and will therefore not be further described.

Figure 1B:
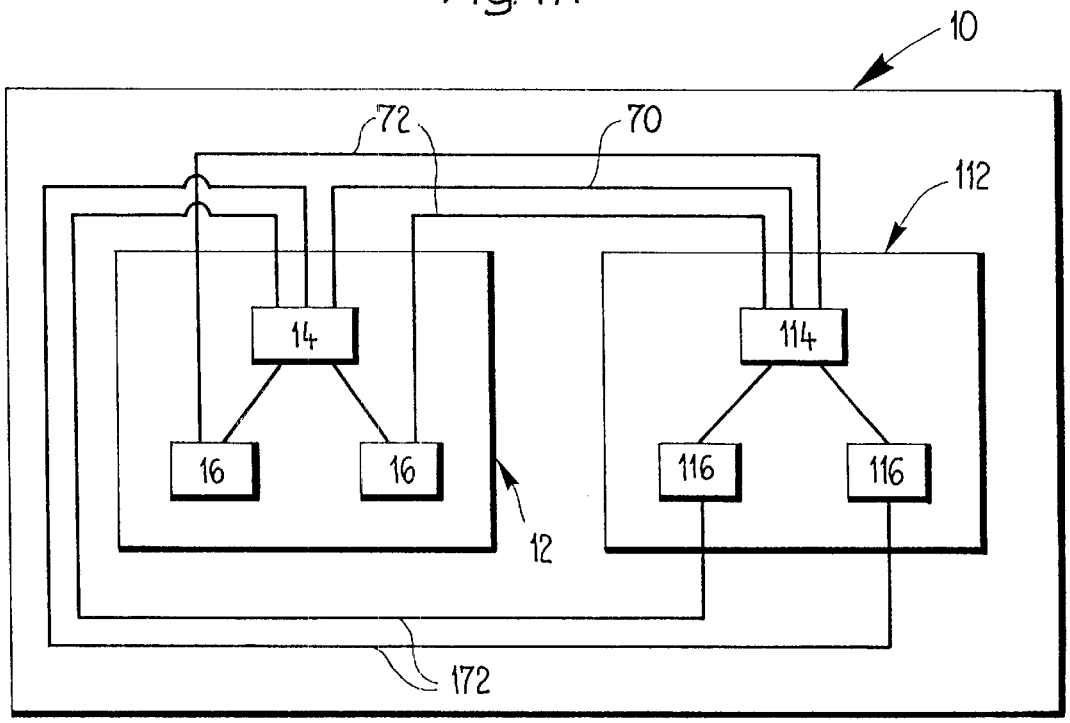
FIG. 1B is a schematic representation of a further firing group with two linked firing units.
Figure 1C:
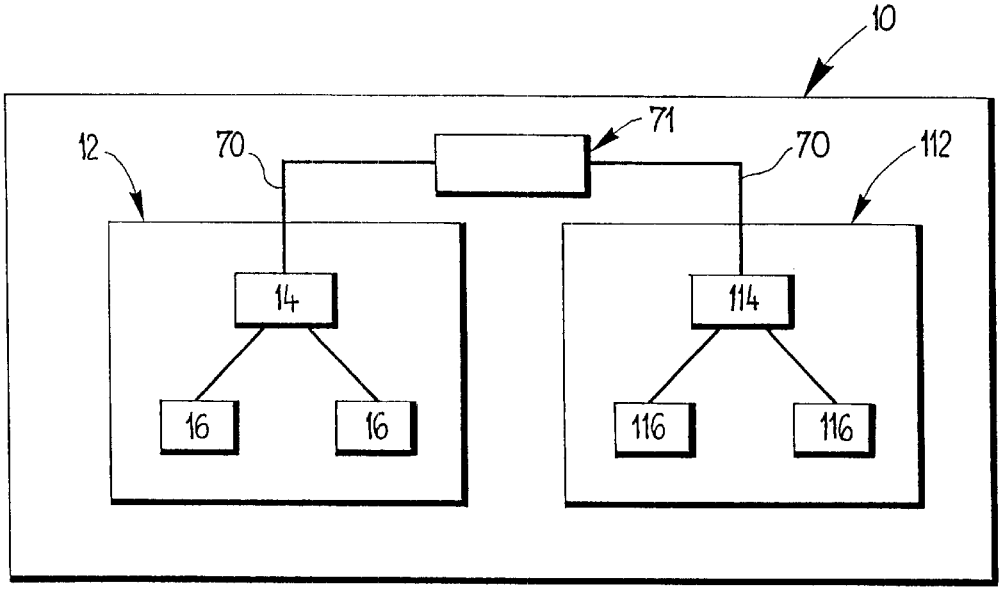
FIG. 1C is a schematic representation of a firing group with two linked firing units and a central electronic device.

FIG. 1B shows a firing group which, in addition to the signal transmission device 70 connecting the fire control units 14,114, has further signal transmission units 72, 172, by means of which the weapons 16,116 are directly connected to the fire control units of the other firing unit 112,12.

The electronics of the firing group 10 are basically decentralized and are constituted by the electronic units of the individual firing units 12, 112. Should these decentralized electronics not be sufficient in certain cases, an additional electronic device 71 can be provided, such as is shown with the firing group in accordance with FIG. 1C.

Figure 1D:
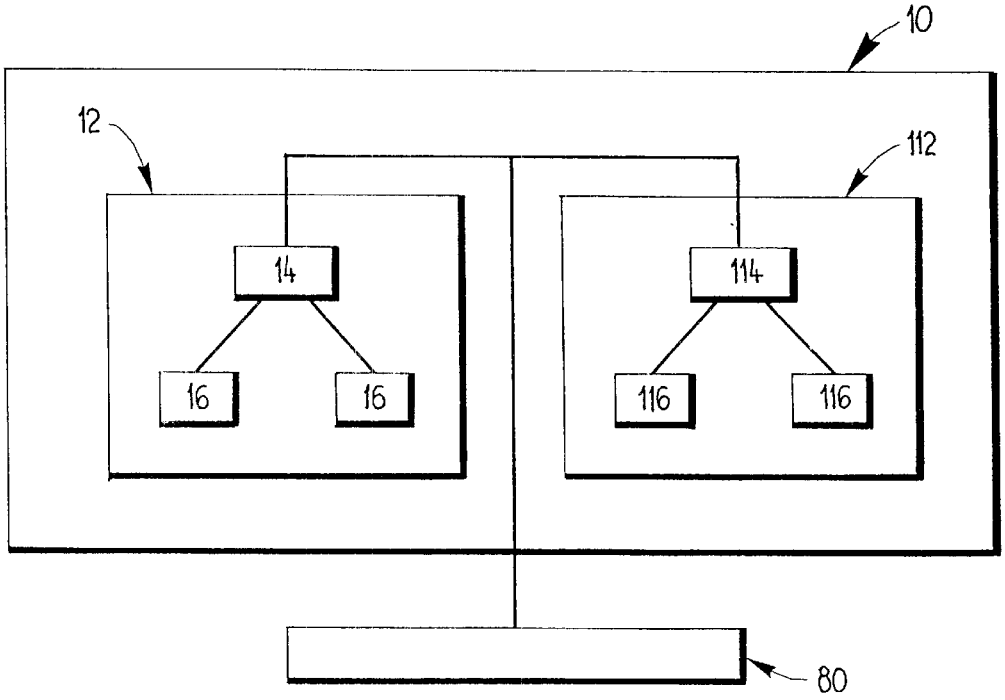
FIG. 1D shows a further firing group with two linked firing units which are connected to an early warning system.

FIG. 1D shows a firing group 10, which is connected to an early warning system 80, the deployment of the antennas in particular can be determined by means of this.

Figure 2:
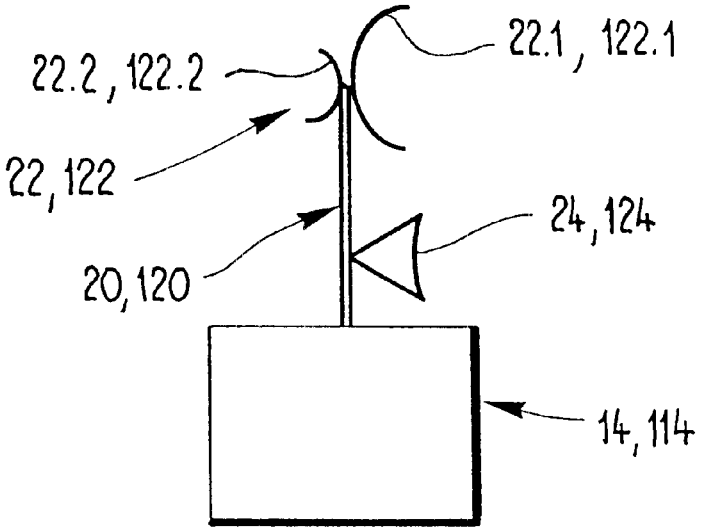
FIG. 2 is a schematic representation of a fire control unit with its antenna system.

In accordance with FIG. 2, each fire control unit 14, 114 has an antenna system 20, or respectively 120, with several antennas. A permanently rotating, or respectively azimuth-changing search antenna unit 22, or respectively 122, is used for searching for aerial targets, and a tracking antenna 24, or respectively 124, which permanently tracks the aerial target, is used for the acquisition of the aerial target and the ranging of the target position of the aerial target already detected by the rotating search antenna unit 20, or respectively 120. Each search antenna unit 22, or respectively 122, comprises two search antennas 22.1, 22.2, or respectively 122.1, 122.2, one search antenna of which is deployed selectively, i.e. in accordance with the tactical decision. The embodiment and the respective selection of the individual search antennas is determined as a function of the topographic conditions, and possibly the expected threat. In the present exemplary embodiment, the first search antenna 22.1, or respectively 122.1, is provided for monitoring the area near the ground of the air-space, and the second search antenna 22.2, or respectively 122.2 for monitoring the higher areas of the airspace.

Figure 3A:
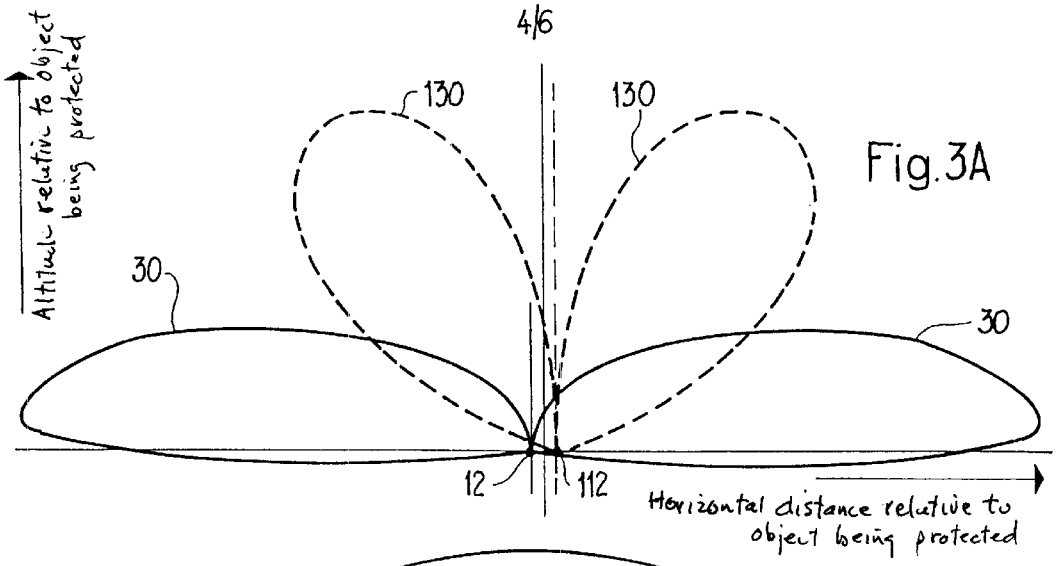
FIG. 3A is a lateral view of the search area which can be covered by the search antennas of two firing units.
Figure 3B:
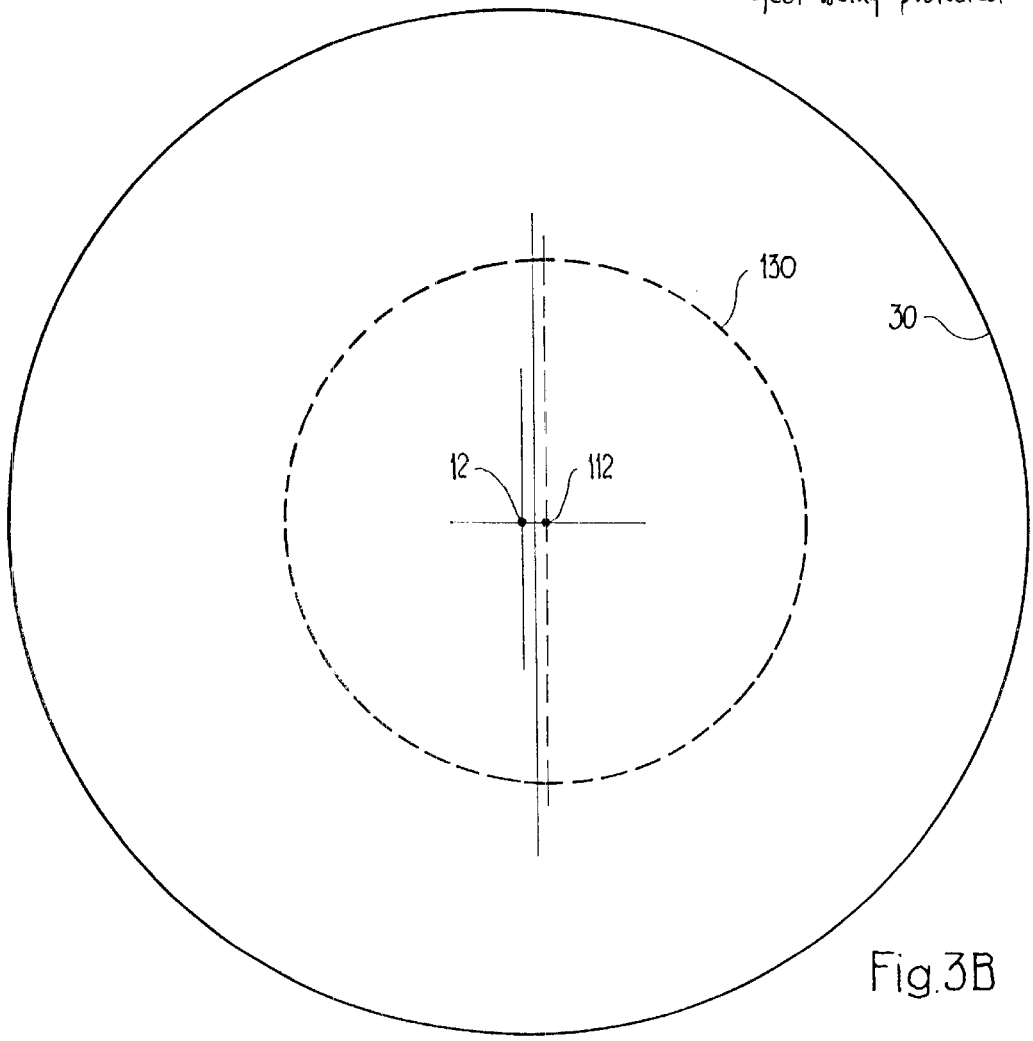
FIG. 3B shows the search areas represented in FIG. 3A from above.

FIGS. 3A and 3B show the areas 30, 130 of the airspace, which can be covered by respectively one of the search antennas of the two firing units 12, 112. Both firing units 12, 112 have a first antenna for the airspace near the ground, and a second antenna for higher altitudes. The antenna for the area near the ground of the firing unit 12 is active, an area 30 can be covered by it. The antenna for higher altitudes of the firing unit 112 is active, an area 130 can be covered by it.

Figure 3C:
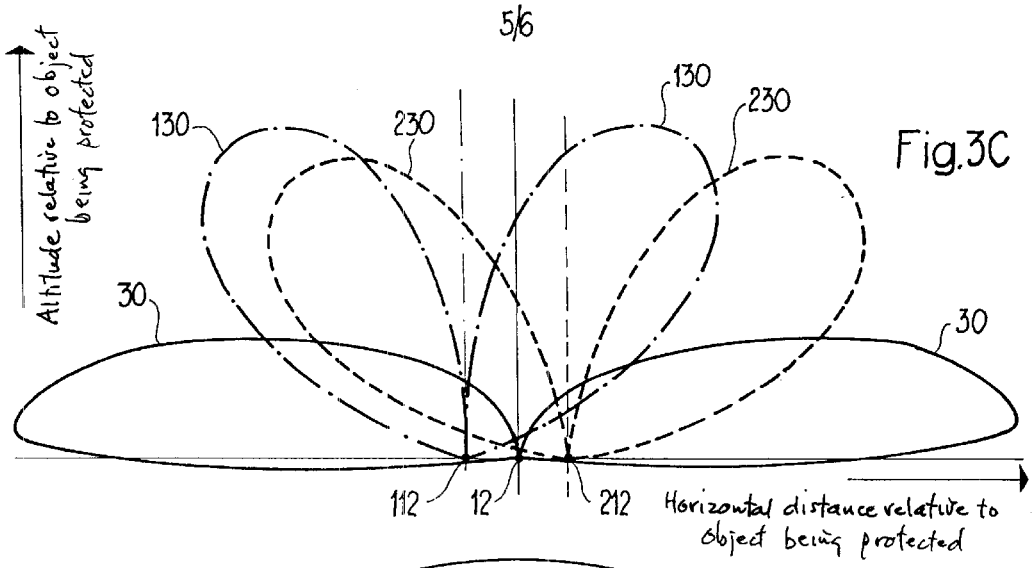
FIG. 3C is a lateral view of the search area which can be covered by the search antennas of three firing units.
Figure 3D:
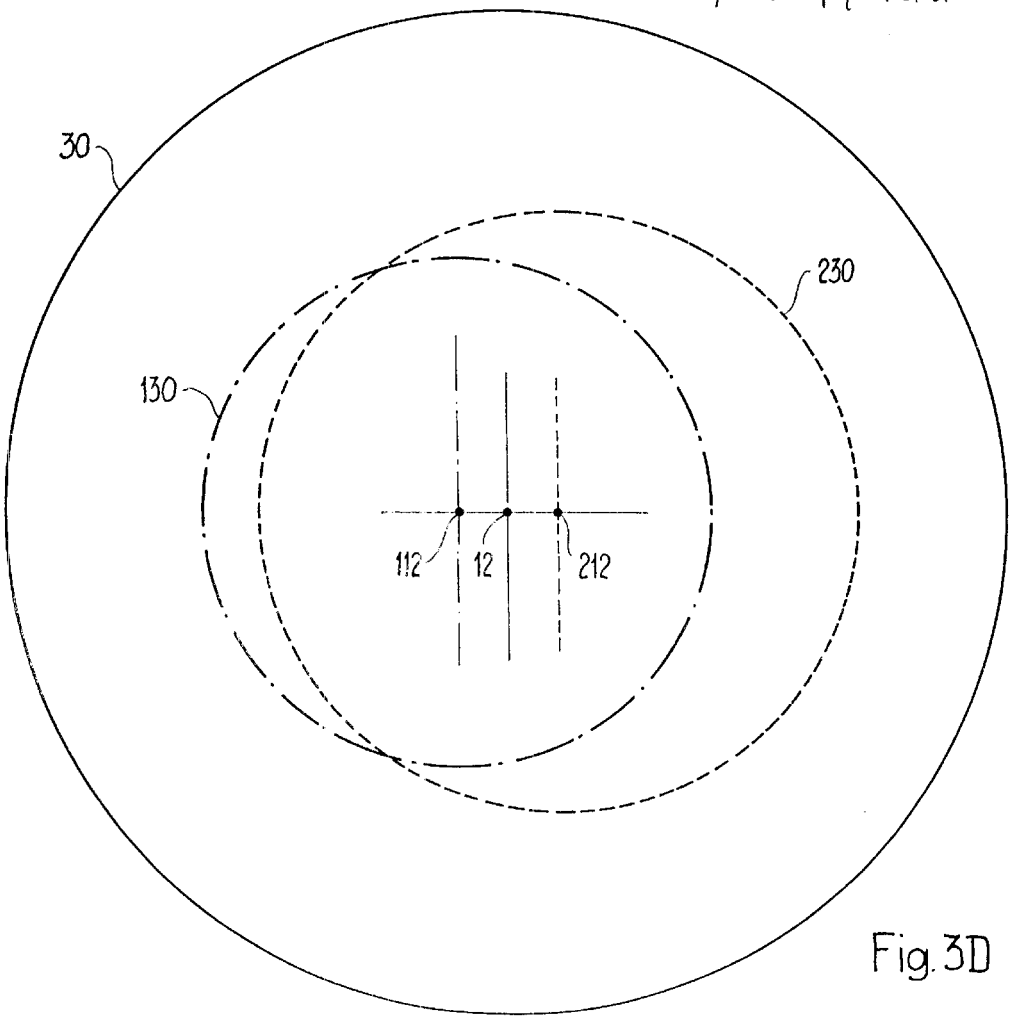
FIG. 3D shows the search areas represented in FIG. 3C from above.

FIGS. 3C and 3D show the areas 30, 130, 230 of the airspace which can be covered by the search antenna units of the two firing units 12, 112, and of a third firing unit 212. Here, too, all firing units 12, 112, 212 have a first antenna for the airspace near the ground, and a second antenna for higher altitudes. The antenna for the area near the ground of the firing unit 12 is active, an area 30 can be covered by it. The antenna for higher altitudes of the firing unit 112 is active, an area 130 can be covered by it. The antenna for higher altitudes of the firing unit 212 is also active, but with a somewhat different setting than the antenna of the firing unit 112.

Figure 4:
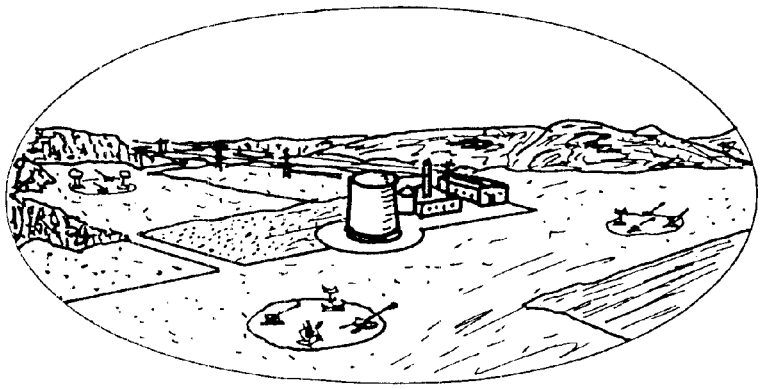
FIG. 4 represents a firing group with three firing units deployed for defending an object to be protected.

FIG. 4 shows three firing units linked into a firing group for defending a stationary object to be protected, for example a nuclear power plant, against the attacks by aerial targets. However, objects to be protected can also be only temporarily stationary, or be mobile within limits. In particular, the firing units themselves, or defined areas of the terrain containing battle lines can be designated objects to be protected.

Figure 5:
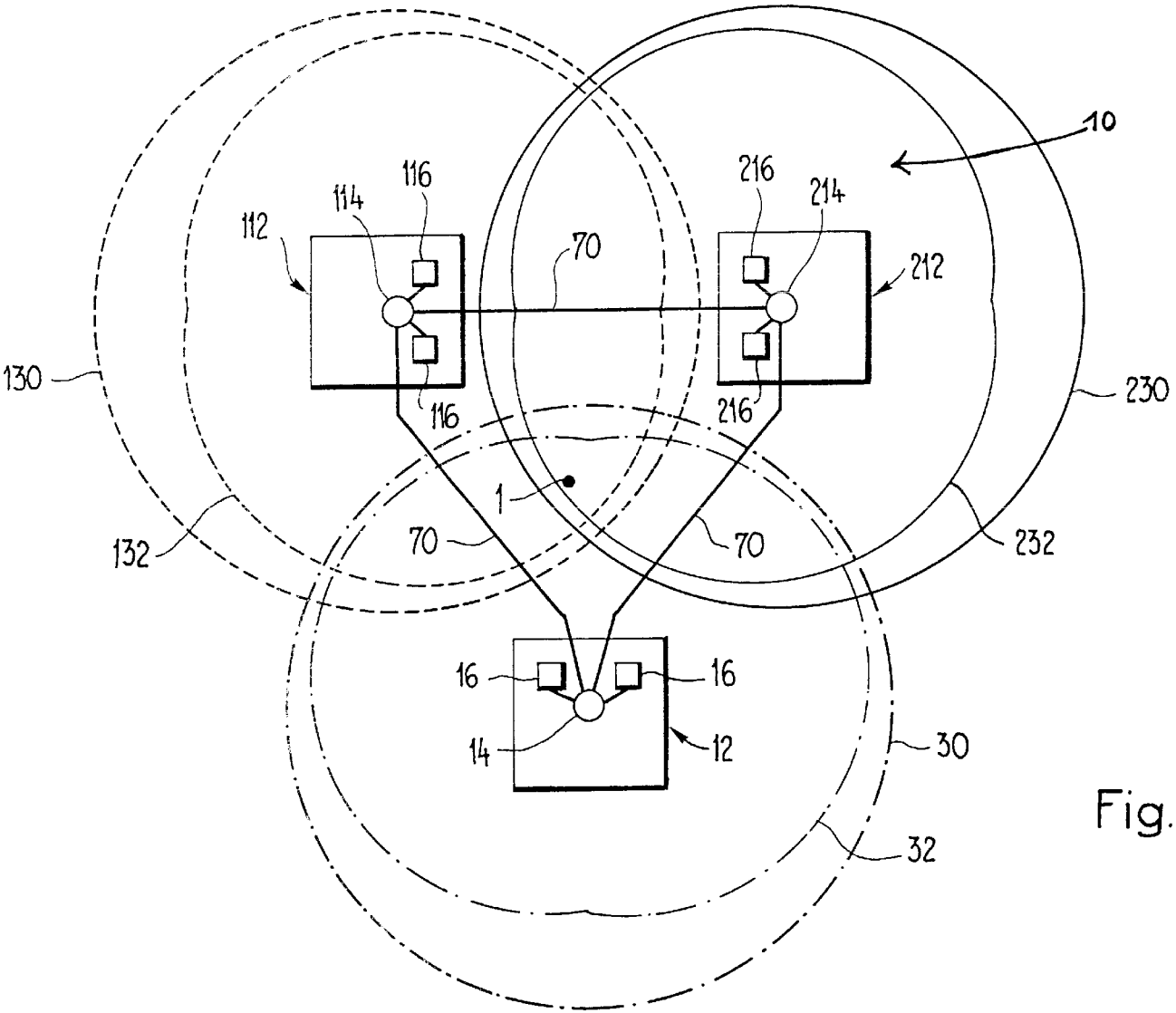
FIG. 5 represents an overview of a firing group with three firing units.

Reference is made in particular to FIG. 5 in connection with the functioning of the firing group 10 in accordance with the invention. It shows the firing group 10 with the three firing units 12, 112, 212, which are linked by means of the signal transmission device 70. The firing units 12, 112, 212 each comprise a fire control unit 14, or respectively 114, or respectively 214, as well as two weapons 16, or respectively 116, or respectively 216, each. If possible, the arrangement of the firing units is selected such that an object 1 to be protected is at approximately the same distance from each firing unit. However, topographic and tactical points of view must generally also be taken into consideration for the position of the firing units. The areas 30, 130, 230, which can be covered by the antennas of the individual fire control units 14, 114, 214 overlap, and the areas 32, 132, 232 which can be reached by the weapons 16,116, 216 also overlap. Each firing unit has its individual electronics. The firing units are autonomous in monitoring the firing units, and also in the assessment of the threat and the selection of the aerial target to be engaged by them. But the firing units nevertheless act in a coordinated manner, since for the corresponding calculations each fire control unit has decisions from the totality of the data available, which provide information regarding the result of the search process of all antennas as well as the respective status of the weapons. It is possible for each fire control unit to engage the aerial target which it would also engage in the non-linked state, and certain aerial targets can be found and engaged only by one firing unit. In many cases, however, aerial targets are detected by two, and more rarely three, firing units and can also be engaged by two or three firing units. The results of the search antennas of all firing units are available to each firing unit for threat assessment, and the selection of the aerial target to be engaged is made as well by each firing unit, taking into consideration the respective status of all weapons. If one of the firing units fails, the total search areas of the antennas and the total effective range of the weapons is reduced, but no change occurs in respect to the method for engaging the aerial targets, since the two remaining firing units continue to act autonomously and in a coordinated manner in the same way as the three firing units at the start.

Besides information relating to the search actions of its antennas and the state of its weapons, each fire control unit also has knowledge regarding all relevant results of the search actions of the further antennas and the status of the weapons directly connected to it. All data freshly detected by the antenna system and available in the firing group regarding the aerial targets present, i.e. the target information, are transmitted to each fire control unit through the signal transmission system. The information from its individual antennas and regarding its individual weapons are used by the fire control unit only after the transmission of this information to the other fire control units has taken place. Thus, all fire control units simultaneously have the information to be used, and corresponding calculations on the basis of this information are performed not only in accordance with the same logic, but also synchronously. In this way the same picture of the situation in the air is basically synchronously generated in all fire control units, and they arrive at the same threat assessment. Decisions regarding the target acquisition and tracking and the miscellaneous deployment of the weapons are made on the basis of the threat assessment of the actual threat. On the basis of the status information and of the threat assessment based on the target information, each fire control unit autonomously decides which target should be engaged by the weapons directly connected to it. The logic on which this decision is based can also be comprehended by the other fire control units and is taken into consideration when making their individual decisions, thus target tracking takes place in a coordinated autonomous way. Finally, on the basis of the threat assessment and the status information from the other fire control units, each fire control unit autonomously decides which target should be engaged by its individual the weapons. The corresponding decision logic can also be comprehended by the other fire control units and is taken into consideration when making their own decisions, thus weapons deployment takes place in a coordinated autonomous way.

Express mention is made that in the firing group in accordance with the invention there need not be a correlation between the status of one fire control unit and the status of the weapons directly assigned to it, i.e. the weapons of its individual firing unit. For example, within a firing group, a fire control unit can perform the lead calculations for its weapons by means of target data determined by a fire control unit of another firing unit. The firing group in accordance with the invention with linked firing units differs in this way from conventional firing groups with non-linked firing units.

The signal transmission device is designed in such a way that during the employment of the firing group it transmits a plurality of data for a fire control unit of a first firing unit to the fire control units of the further firing units. The data transmitted from a fire control unit will be described in what follows. A corresponding data transfer of course takes place from each one of the fire control units. In particular, the transmitted data relate to an identification number, by which the firing unit of the first fire control unit is identified, the status of the first fire control unit, the status of the weapons of the first firing unit, a first target number, by which the aerial target to be engaged, or respectively being engaged by the fire control units of the first firing unit, is identified, a second target number by which the aerial target to be engaged, or respectively being engaged by the weapons of the first firing unit, is identified, the estimated length of time until the weapons of the first firing unit are fired, the fact that the firing criteria have been met by the weapons of the first firing unit, the firing of the weapons of the first firing unit, the inactivation of the aerial target engaged by the weapons of the first firing unit, i.e. of the aerial target identified by the second target number, wherein inactivation should be understood to mean that the aerial target no longer can achieve its present mission, either because it is completely destroyed, not completely destroyed, but presently no longer deployable, or has been deflected from its target, every two-dimensional target track which has been calculated by the electronics of the fire control unit of the first firing unit, this target track being distinguished by a target track number which, however, is only definite within its individual firing unit, data for localizing the target track in relation to the coordinate system of the fire control unit of the first firing unit, consisting of the azimuth and the distance and the validity time of the track, information relating to target tracks canceled by the electronics of the fire control unit of the first firing unit, three-dimensional target data generated by the electronics of the fire control unit of the first firing unit by means of target data filtering, non-settled target data are called 3-D target data, settled target data are called 3-D+target data, these target data consist of azimuth, distance and elevation and contain the following information:

a target number, which need not be identical with the above mentioned target number, the position, speed and acceleration of the aerial target in relation to the appropriate coordinate system of the fire control unit of this first firing unit, the validity time of the target data, the quality of the target data, i.e. a statement of whether they are 3-D target data or 3-D+target data, and the size of the target, wherein a qualitative distinction is made only between "large" and "small".

Making all data available for the purpose of using them in calculations takes place in such a way that these data are each simultaneously available in all receiving fire control units, the same as in the transmitting fire control unit. These data would be available earlier in the transmitting fire control unit, i.e. at the start of the transmission process, but because of this transmission process the availability of the data in the receiving fire control units is delayed. So that the utilization of the data can take place in all fire control units simultaneously, i.e. both in the sending as well as the receiving fire control units, in order to arrive at consistent decision-making, the time delay occurring in the course of the transmission of the data to the further, i.e. receiving fire control units, is initiated in the first, i.e. the transmitting fire control unit, so that the utilization of these data in the first fire control unit only starts when the utilization of these data can also start in the further fire control units. Similar is of course also true if one of the further fire control units is the transmitting fire control unit.

Moreover, it is assured by means of the signal transmission system that the time measuring of all fire control units of the linked firing group matches. All time information takes place in correspondence with this time, identified as standard time.

The utilization of the firing group in accordance with the invention will be described in what follows. For the purpose of simplification it is assumed that it is used to protect a single friendly object assumed to be point-like, although basically the defense of several objects to be protected would also be possible.

In the course of the utilization of the firing group, the fire control units for one, as well as the weapons can alternatively take on a different mode, which will be briefly described in what follows.

The fire control units can alternatingly be in the "RESET", "ASSIGN FIRING UNITS", "LOCK ON" or "TRACKING" mode . They are operational in the "RESET" mode, the search antenna, or respectively one of the search antennas, monitors the airspace, but the aiming device is at rest. The "RESET" mode lasts until the decision has been made to assign a target track to the aiming device. In the "ASSIGN FIRING UNITS" mode, the servo units of the aiming devices are guided into a defined desired position. The "ASSIGN FIRING UNITS" mode lasts, until the servo units have reached the mentioned desired position, except if it is interrupted, as will be described further down below. In the "LOCK ON" mode, the servo units are guided into a defined movement, while the tracking sensor, or respectively the tracking antenna attempts to detect the aerial target. The "LOCK ON" mode lasts until the tracking sensor locks on to the aerial target, except if there is a interruption of the mode, as will be described further down below. In the "TRACKING" mode, filtering of the target data for providing the command values for the control of the servo units of the aiming devices is being performed in such a way that the tracking sensor remains aimed toward the aerial target, so that target data are continuously provided. Two phases can be differentiated, namely a first phase until the filters have settled in, and a second phase, starting with settling in of the filters up to the time the aerial target is shot down. A fire control unit of a firing unit which engages the aerial target is in one of the modes "ASSIGN" or "LOCK ON" or "TRACK".

The weapons of a firing unit can alternatingly be in the modes "READY""ASSIGN WEAPONS" and "TRACKING". In the "READY" mode the weapons are operational, and supplied with ammunition, they are at rest or are being brought to rest. The "READY" mode lasts until the decision is made to assign the weapons to an aerial target. The "ASSIGN WEAPONS" mode follows the just described "READY" mode, in the process the servo units of the weapons are brought into the desired movement mode determined by the lead calculation, but have not yet reached it. Unless it is interrupted for defined reasons, the "ASSIGN WEAPONS" mode lasts until the servo units of the weapons have reached the mentioned movement mode. In the "TRACKING" mode the servo units of the weapons are at least approximately in the movement mode which they must assume in accordance with the lead calculation. Unless there is an interruption, the "TRACKING" mode lasts until the aerial target has been shot down. Weapons engaging an aerial target are in the "ASSIGN WEAPONS" or the "TRACKING" mode.

At the start of deployment, the fire control unit of each firing unit of the firing group is fixedly configured for this deployment in that within the search antenna unit the search antenna, which is best suited for the upcoming deployment, is selected. In the process the topographic conditions, miscellaneous knowledge regarding the enemy aerial targets to be expected and the configurations of the further fire control units are taken into consideration. Part of the configuration are also additional selectable antenna-specific data, such as the antenna tilt in case of a fan radiating antenna, for example.

The firing group is then arranged as follows: each firing unit is given a distinguishing identification number. The same as with non-linked firing groups, each fire control unit is aware in relation to its individual coordinate system of the position of its individual weapons, of the contours of the terrain in relation to its individual position as well as of the position of the object to be protected, which is the same for the entire firing group. In addition, each fire control unit is aware of the configuration of the remaining fire control units and, in relation to its individual coordinate system, the position of the remaining fire control units. Moreover, each fire control unit is aware of the contours of the terrain in relation to the position of the further fire control units.

During deployment, each fire control unit provides its individual two-dimensional target tracks. The so to speak drawn connection of points, at which the search antenna has detected an aerial target, is called a target track. In general, these are target echoes, which are created by the ranged target distance and the azimuth, as well as the validity time of the ranging. In general, the target echoes therefore do not correspond to the trajectory flown by an aerial target, it could even be composed of points of different aerial targets, but in such a case would of course be useless. The production of such useless tracks is practically prevented by the steps represented in the section next to the following one in this description.

The target tracks are provided with a target number in a sequence in accordance with their start. Each target track keeps the target track number it has been assigned until it disappears. Target track numbers, to which no target track has been assigned, remain after target tracks have disappeared and which therefore are unoccupied, so to speak. These unoccupied target track numbers are again assigned, or respectively used for numbering new target tracks, wherein the respectively lowest free target track number is first assigned.

So that a target track is actually established, a defined number of target echoes, which are assigned to the respective aerial target, must be detected by the search antenna during a number of sequential sweeps of the aerial target. The detection of a target echo which cannot be assigned to any of the already existing or soon existing target tracks is considered to be the first sweep of a target. The established target track is continuously updated, either by the utilization of newly arriving target echoes, or by means of extrapolating calculations of already received target echoes. The assignment of new target echoes to already established target tracks takes place by means of the correlation of a received target echo with a position of the corresponding aerial target calculated by correlation. If no fresh target echo which could be correlated is received, the status of the target track is updated by means of the extrapolated value.

A target track whose establishment has been initiated or which already exists, is cancelled in two cases, namely for one directly following the start of the establishment, if the search antenna cannot detect any target echoes in the course of a defined number of target sweeps over the aerial target, which could be associated to this target, and otherwise at a later time, if the search antenna does not detect any target echoes, which could be associated with the already existing target track, over a defined number of sequential target sweeps.

Each fire control unit performs a data fusion on the basis of the two-dimensional target track it itself has detected, as well as the corresponding two-dimensional target tracks detected by the remaining fire control units. The data fusion is initiated, or respectively updated by means of a fusion table. The fusion table contains a target number for each aerial target, the amount of correlated two-dimensional target tracks and, should they already be present, the three-dimensional target data. All target tracks of a target are called the amount of two-dimensional target tracks, even if they have been detected by several fire control units, or respectively search antennas. An actual data fusion in the sense of a calculation always takes place when fresh two-dimensional target tracks, or respectively updates of target tracks, are received, while the newly arriving three-dimensional target data are merely registered.

The age of the two-dimensional target tracks is important for their continued processing. The target track wherein the difference between the actual time and its validity time is greater, is defined as the older of two target tracks. A definition is furthermore made which of two target tracks of the same age the one with the lowest identification number in the fire control unit is the older one. If target tracks of the same age also have the same identification number in the fire control unit, the target track having the lower target track number is defined as the older one.

As soon as two-dimensional target tracks are available, the fusion table is initialized in that the target track numbers are processed as follows: the oldest target track is entered in the fusion table and receives the target number 1. The following process is performed with the next newer target track: if it correlates with the oldest target track, it is assigned the same target number, if it does not correlate with the oldest target track, it receives the target number 2. Further target tracks are correspondingly treated, i.e. the method steps are repeated, until all target tracks have been processed. However, a target track is only assigned a defined target number if it correlates with all already correlated target tracks of the same target number.

Following the just described initialization of the fusion table, all further incoming two-dimensional target tracks are processed as follows, respectively starting with the oldest: if the further target track can be associated with an already existing target number and correlates with all previously known target tracks of this target number, the fusion table is updated by entering this target track. If the further target track cannot be assigned to any of the already existing target numbers, a further target number is established in the same way as with the initialization of the fusion table.

As already mentioned, it is possible under certain conditions to cancel target tracks. If this is the case, the entry at the corresponding target number is cancelled, however, this does not absolutely mean that the target number itself is also cancelled, since the target track is the result of the detection by a single fire control unit, while the target number can be based on the detection by several fire control units. But if all target tracks of a target number are cancelled, the aerial target is considered to be non-existent, and the target number is released for a fresh entry. Target numbers being released are occupied by entries based on the data of fresh target tracks, or respectively of those arriving for the first time, wherein the lowest free target number is respectively occupied first.

Subsequently to the data fusion, each fire control unit performs a threat assessment, and this respectively for all target numbers listed in the fusion table. Knowing a two-dimensional target track, the magnitude of the threat to an object to be protected is defined as a function of the distance and the distance rate of the aerial target in relation to the position of the object to be protected. If the target track, or respectively its latest update, is older than the time of the threat assessment, the distance and distance rate to the object to be protected are determined by extrapolation from the previously known data for the target track. If there is no two-dimensional target track for the object to be protected available at a fire control unit, the distance and the distance rate are calculated by coordinate transformation from the appropriate data of other fire control units. The center of the search area covered by the search antenna of the fire control unit which has generated the target track is used as the elevation.

If three-dimensional target data are available for the observed two-dimensional target track, they will be used as follows:

If a data number contains three-dimensional target data which, however, have not yet settled, the distance is calculated from these and the distance rate from the observed two-dimensional data track is used. If a target number contains three-dimensional and settled target data, the distance and the distance rate are calculated from these. If a target number contains three-dimensional, non-settled target data, but no more two-dimensional target tracks, the distance is calculated from the three-dimensional target date, and the latest calculated distance rate is used.

The maximum of the magnitude of the threats in relation to the position of the fire control unit making the calculations and of the further fire control units and the object to be protected is defined as the magnitude of the threat by a two-dimensional target track. The maximum of the magnitude of the threat in respect to all target tracks correlated under the associated target number is defined as the magnitude of a threat by an aerial target.

The result of the threat assessment is registered in a threat table, in which the target numbers are entered; as a function of the magnitude of their threat. If in accordance with the above definition two aerial targets are equally threatening, the aerial target with the lowest target number is defined as the most threatening.

In order to assure a certain stability of the threat table, it is determined that in an update of the threat table a target number can only be displaced from its position by another target number if the displacing target number poses a threat of a magnitude which is greater by at least 20% than the magnitude of the threat by the displaced target number.

As a result of the threat assessment, each fire control unit itself performs the selection of the target track for the aiming device of its firing unit. This takes place as follows:

A selection of the fire control units which are to take part in the engagement is made, only fire control units which are in the "RESET" mode can be considered for this. Moreover, the selection of the aerial targets to be engaged is made. This is limited to aerial targets which are not already being engaged by the fire control unit of firing unit, wherein the number of selected aerial targets maximally corresponds to the number of the selected fire control units. The engagement of the aerial targets then takes place in the sequence of their threat to the object to be protected as listed in the threat table. Basically, the calculation of the distances then takes place, and all fire control units whose distance from the aerial target exceeds a maximum lock-on distance are not used for deployment to this aerial target. The distances of the remaining fire control units to the aerial target are arranged in accordance with their size wherein, with distances of the same length, the one with the lower identification number is defined as the shorter from the fire control unit of the firing unit. Now a differentiation between two cases is made: the first case relates to fire control units which provide the two-dimensional target tracks of the aerial target, and the second case relates to fire control units which do not provided two-dimensional target tracks. In the first and second cases, the fire control unit whose distance from the aerial target is the greatest is no longer used for engaging the aerial target, and the corresponding method steps are repeated with the next threatening target, except if the fire control unit with the greatest distance from the aerial target were the fire control unit making the calculations. In this case, a so-called self-lock-on with the aid of its individual target track takes place in the first case, and in the second case a so-called outside lock-on with the aid of the most recent of all two-dimensional target tracks. The method steps for the self-, or respectively outside, lock-on are repeated for each one of the selected aerial targets to be engaged until the fire control unit making the calculations is assigned a target, or all selected aerial targets have been processed. If it is found that two fire control units engage the same target, the fire control unit whose firing unit has the highest identification number immediately returns into the "RESET" mode.

It is established that an aiming device changes its aerial target only if every fire control unit is already engaging an aerial target and there is in addition a further aerial target which has not yet been engaged and whose threat exceeds the threat of at least one of the engaged aerial targets. The decision of whether a target change should take place-is made by the fire control unit which at that moment is engaging the least threatening aerial target, and this is also the fire control unit which will make a possible target change. If the deciding fire control unit is still in the "ASSIGN" or "LOCK-ON" modes, a target change always takes place, if the deciding fire control unit is already in the "TRACKING" mode, a target change always takes place, but which can be delayed until the end of an already initiated firing period.

The target selection for the weapons respectively takes place by means of the individual fire control unit of the firing unit when the weapons are in the "READY" mode and aerial targets, which can be engaged, are registered by the fusion table. Here, only those aerial targets should be considered for engagement, for which there are three-dimensional, non-settled or settled target data are available. First those aerial targets and firing units are selected, which will take part in these method steps, namely those firing units, whose weapons are in the "READY" mode, and those aerial targets, which can be engaged but have not been engaged by a firing unit of the firing group. Thereafter the selection of the aerial targets which can be engaged takes place in the sequence of their threat to the object to be protected. This is started with estimating the distance to the impact point. All firing units, whose distance to the impact point falls below a defined minimum distance, are excluded from the selection. If this applies to all firing units, the selection of the next threatening aerial target is started immediately. The distances to the point of impact which fall above the minimal distance are arranged by size wherein, with equal distances to the impact point, the one with the lower fire unit identification number is defined as the shorter one. If the aerial target is one which has been assessed as large, those firing units from where the aerial target is invisible are no longer considered for its selection, and if this applies to all firing units of the firing group, the selection of the next threatening target begins immediately. It should be noted here, that visibility can only be reduced by topographic obstacles. If the distance to the impact point from the firing unit of the fire control unit which performs the calculations is the shortest, the lead calculation and the assignment of the weapons for the respective aerial targets are performed. Otherwise the firing unit from which the shortest distance to the impact point was determined, is no longer considered for the selection of the aerial target, and if this applies to all fire control units not performing calculations, the aerial target is defined as being engaged and the selection of the next threatening aerial target is begun immediately. The just described method steps are repeated until an aerial target is assigned to the weapons of the fire control unit performing calculations, or respectively until all aerial targets have been processed. There can also be a case where all aerial targets had been processed, no aerial target had been assigned to the weapons of the fire control unit performing calculations, but nevertheless there are targets which can be engaged, but have not yet been engaged. In this case the method is repeated without taking the size of the aerial target, or respectively the condition of visibility, into consideration. This is done with the inclusion of all remaining firing units and all targets which can be, but have not yet been engaged. This is repeated until the weapons of the fire control unit performing calculations are assigned an aerial target, or respectively until all aerial targets have been processed. If then all aerial targets have been processed without an aerial target having been assigned to the weapons of the fire control unit performing the calculations, the appropriate method steps are repeated, taking into consideration the size of the aerial target, or respectively the condition of visibility of all aerial targets which can be engaged, until the weapons of the fire control unit performing calculations are assigned an aerial target, or respectively until all aerial targets have been processed. If then all aerial targets have been processed without an aerial target having been assigned to the weapons of the fire control unit performing the calculations, the appropriate method steps are again repeated, without taking into consideration the size of the aerial target, or respectively the condition of visibility of all aerial targets which can be engaged, until the weapons of the fire control unit performing calculations are assigned an aerial target, or respectively until all aerial targets have been processed.

A brief explanation of the manner in which the distance to the impact point is estimated follows. The weapons position is defined as the central point of the positions of the weapons of the appropriate firing unit. The distance to the impact point between an aerial target and a weapons position is based on the position and the speed of the aerial target in relation to the weapons position at the moment of calculating the distance to the impact point. In this case a constant speed of the aerial target is assumed for the sake of simplicity. The position and the speed of the aerial target are calculated either from non-settled, three-dimensional targets and the latest two-dimensional target track, or from settled three-dimensional target data. If required, extrapolation calculations regarding the time of the calculation of the distance to the impact point and/or coordinate transformations are performed.

Target changes of the weapons of a firing unit take place when the weapons are in the "ASSIGN" or "TRACKING" modes, namely in three cases: the first case exists when an aiming device has performed a target change, the second case, when a target which could be engaged has been neutralized and further targets which can be engaged are available, and the third case, when there are targets which can be engaged and are engaged by the weapons of several firing units, while aerial targets which can be, but have not been engaged, are available.

A firing unit, whose weapons engage an aerial target, commences firing after the following four criteria have been met: first, the target data used for fire control must have settled in. Second, the weapons of the firing unit, or at least two weapons of the firing unit, must be in the "TRACKING" mode. Third, the average value of the distances-to the impact points of the weapons of the firing unit must be less than or equal to the maximally possible distance to the impact point. Fourth, the aerial target must be visible from at least one of the weapons of the firing unit. The distance to the impact point at which an aerial target can be neutralized, i.e. an abort of its mission takes place at a probability of at least 30%, is defined as the maximum distance to the impact point. This maximum distance to the impact point is not absolute, but with each aerial target depends on the size and the direction of flight of the latter is relation to the weapons. If at the end of the flying time of the last fired projectile the aerial target has not been inactivated, firing commences again. This is continued as long as the target has not been inactivated and target data are available.

The above described firing group and the description of the method employed when it is used, should be considered to be only one of a multitude of possibilities. A plurality of variations is conceivable both as to the apparatus as well as to the considerations on which the definitions and decisions in connection with the employment of the firing group are based.

What is claimed is:

1. A method for engaging at least one aerial target by means of at least two firing units linked to form a firing group, comprising the steps of:

autonomous monitoring by said firing units of airspace to search for at least one aerial target, said firing units automatically reporting their autonomous results of monitoring to the other firing units in said firing group and receiving the results of monitoring by said other firing units, so that all firing units have the same air situation monitoring information available to them, automatically assessing the threat autonomously by each firing unit using the monitoring information collected from all the firing units, so that all firing units arrive at the same threat picture, only after all firing units have been fully apprised of all the available monitoring information, automatically assigning an aerial target to be attacked autonomously by each firing unit using the same assignment logic and monitoring information used by all other firing units, which assignment logic causes the attack assignments to be made in a predictable and coordinated manner.

2. A firing group comprising:

at least two firing units, each said firing unit having a fire control unit and at least one weapon, which firing units are linked by a signal transmission system, wherein each fire control unit has an autonomous antenna system for searching, tracking and ranging an aerial target, a system for assessing the threat of said aerial target in coordination with other firing units and a system for autonomously selecting the aerial targets to be engaged by said weapon using the same assignment logic and target information used by all other firing units, which assignment logic causes the attack assignments to be made in a predictable and coordinated manner but only after all firing units have been fully apprised of all the available monitoring information.

3. The firing group in accordance with claim 2, wherein each fire control unit both monitors aerial targets and selects targets to attack.

4. The firing group in accordance with claim 2, wherein at least the totality of the fire control units has search antennas, which are designed for sweeping different areas of the airspace.

5. The firing group in accordance with claim 2, wherein said firing group can be connected to an early warning system by means of a signal transmission unit.

6. The firing group in accordance with claim 2, wherein aerial targets to be engaged are rapidly moving aerial targets.

7. The firing group in accordance with claim 4, wherein the weapon of one firing unit is connected to both the fire control unit of its own firing unit and also the fire control unit of a different firing unit.

8. The method in accordance with claim 1, wherein the assignment of an aerial target to be attacked by a firing unit takes place by considering the threat to the object to be protected and the status of the weapons of the firing group.

9. The method in accordance with claim 1 wherein the firing group is connected with an early warning system.

* * * * *